US008721425B2

(12) United States Patent
Svarichevsky et al.

(10) Patent No.: US 8,721,425 B2
(45) Date of Patent: May 13, 2014

(54) GAMING SYSTEM AND METHOD OF USE

(76) Inventors: Stanislav Svarichevsky, St. Petersburg (RU); Anton Zailinger, Salzburg (AT); Dariusz Chyla, Cracow (PL); Anna Chyla, Cracow (PL); Heinz Fridrich, Leobersdorf (AT)

( * ) Notice: Subject to any disclaimer, the term of this patent is extended or adjusted under 35 U.S.C. 154(b) by 765 days.

(21) Appl. No.: 13/011,657

(22) Filed: Jan. 21, 2011

(65) Prior Publication Data

US 2012/0190429 A1 Jul. 26, 2012

(51) Int. Cl.
*G07F 17/32* (2006.01)

(52) U.S. Cl.
USPC ..... 463/20; 463/16; 463/25; 463/29

(58) Field of Classification Search
USPC ..... 463/16, 20, 25
IPC ..... G07F 17/32
See application file for complete search history.

(56) References Cited

U.S. PATENT DOCUMENTS

2003/0064778 A1 * 4/2003 Berman et al. ..... 463/20

* cited by examiner

*Primary Examiner* — Omkar Deodhar
(74) *Attorney, Agent, or Firm* — Rob L. Phillips; Greenberg Traurig, LLP

(57) ABSTRACT

A gaming system and method involving a fixed bonus code and dynamic game code wherein one or more players playing multiple designated electronic gaming machines attempt to match a dynamic game code to the bonus code to win a fixed jackpot or progressive jackpot. The game code symbols adjust randomly (i.e., change) responsive to each play of a corresponding electronic gaming machine. Once a game code symbol matches a corresponding bonus code symbol, the game code symbol locks up such that the matching game code symbol cannot adjust again until the jackpot is won based on each game code symbol matching a corresponding bonus code symbol. Different electronic gaming machines may be re-assigned to drive different game code symbols as needed.

12 Claims, 10 Drawing Sheets

GAMING SYSTEM AND METHOD OF USE

FIELD OF THE INVENTION

The embodiments of the present invention relate in one aspect to gaming systems involving multiple designated gaming machines configured to collectively generate a jackpot winnable by one or more players through play on said designated gaming machines.

BACKGROUND

Casino gaming has expanded quickly over the past twenty years and is now legal in many countries throughout the world. The popularity of electronic gaming machines (e.g., slot machines) is at least partially responsible for the expansion of casino gaming. To maintain player interest, electronic gaming machines now utilize video monitors, high-quality graphics, bonus games, progressive jackpots and/or other attractions. Despite the advances, game manufacturers and developers must continue to create new and exciting electronic gaming devices and systems to maintain the interest of current players and attract new players.

Accordingly, it would be beneficial to utilize multiple designated electronic gaming machines to generate a progressive jackpot which may be won by one or more players working together to generate a pre-established community outcome based on play of each of said designated electronic gaming machines. Advantageously, the designated electronic gaming machines may be programmed to display, and branded with, themed content which players find attractive. Further, stand alone electronic gaming machines should benefit from the embodiments of the present invention as well.

SUMMARY

Accordingly, one embodiment of the present invention comprises a system of designated electronic gaming machines from which a percentage of play funds a progressive jackpot. A randomly established fixed bonus code and dynamic game code formed of numerous symbols drive the embodiments of the present invention. Ideally, the bonus code and game code are prominently shown to players on a community display such as a large display or monitor above a bank of designated electronic gaming machines and/or on a display associated with each electronic gaming machine. In one embodiment, the bonus code and game code includes a quantity of symbols equal to a quantity of designated electronic gaming machines. For example, a bank of five designated electronic gaming machines has a five symbol bonus code and game code. Each play of each designated electronic gaming machine causes at least one symbol of the game code to randomly adjust a level. Once a game code symbol matches a corresponding bonus code symbol, the matching game code symbol is locked such that it can no longer adjust. Once each game code symbol matches its corresponding bonus code symbol, the progressive jackpot is awarded in a shared fashion, based on wager amounts, to each player playing one of said designated electronic gaming machines.

In one embodiment, each electronic gaming machine drives a corresponding game code symbol. Once a game code symbol is locked, the corresponding electronic gaming machine may be switched or re-assigned such that play of the electronic gaming machine drives a different game code symbol. If there are less unlocked game code symbols remaining than electronic gaming machines being player, play of multiple electronic gaming machines may drive a single game code symbol. The bank display and/or game display show players which electronic gaming machine is driving which game code symbol.

In one embodiment, a bank of designated electronic gaming machines under the embodiments of the present invention, are promoted under a safe cracking theme complete with safe combination dials and related symbols. The embodiments of the present invention may also be used with, and facilitated by, any bank or system of electronic gaming machines utilizing any desired theme.

In addition, play of a single gaming machine may drive one or more game code symbols. That is, a standalone electronic gaming machine may benefit from the embodiments of the present invention as well as a bank of electronic gaming machines.

Other variations, embodiments and features of the present invention will become evident from the following detailed description, drawings and claims.

DETAILED DESCRIPTION

Figure 1:
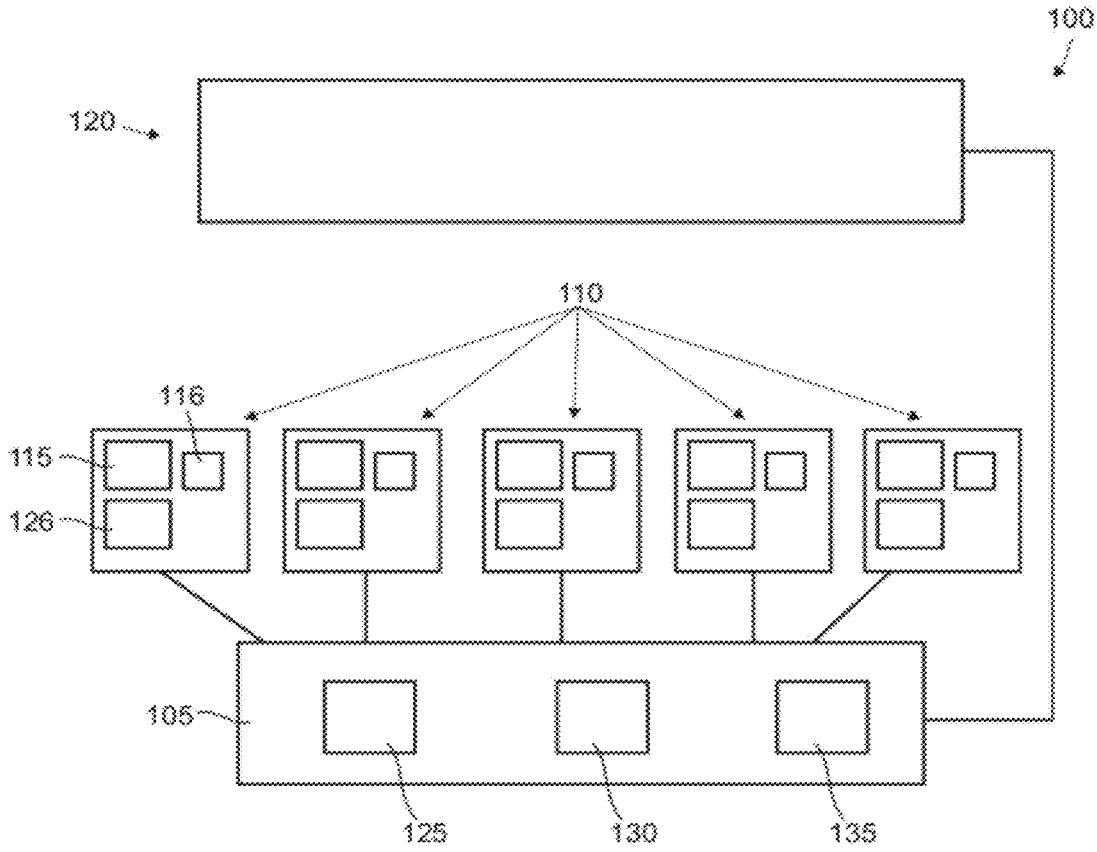
FIG. 1 illustrates a block diagram of a system according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

FIG. 1 is a block diagram of gaming system 100 in accordance with the embodiments of the present invention. The gaming system 100 includes a game controller 105 networked or otherwise in communication with a plurality of individual gaming machines 110. The term "electronic gaming machine" may refer to any device, activity or mode of play for gaming (i.e., gambling or redemption), amusement, competition, or other purposes. Each electronic gaming machine 110 may be located locally or remotely with respect to one another.

In one embodiment, the game controller 105 is, or includes, a pre-programmed processor configured to communicate with a large bank monitor or display 120 and the electronic gaming machines 110. The bank display 120 may be positioned above or next to the bank of electronic gaming machines 110. The game controller 105 may also include memory 125, a random number generator 130 and one or more input and/or output (I/O) devices or peripherals 135 to facilitate communication with the bank display 120 and electronic gaming machines 110. Each electronic gaming machine 110 also has a processor 115, memory 126 and optionally an RNG 116 for generating game outcomes.

Processor 115 is a hardware device capable of executing software, particularly that stored in memory 125, 126. The processor 115 can be any custom made or commercially available processor, a central processing unit (CPU), a semiconductor based microprocessor (in the form of a microchip or chip set), a macroprocessor, or generally any device for executing software instructions.

Memory 125, 126 can include any one or combination of volatile memory elements (e.g., random access memory or RAM) such as DRAM, SRAM, SDRAM and non-volatile memory elements such as read-only memory (ROM), hard drive, tape or CDROM. Moreover, the memory 125, 126 may incorporate electronic, magnetic, optical, and/or other types of storage media. Note that memory 125, 126 can have a distributed architecture, where various components are situated remote from one another, but can be accessed by the processor 115.

Gaming software in memory 125, 126 may include one or more separate programs, each of which comprises an ordered listing of executable instructions for implementing logical functions. The gaming software can be a source program, executable program (object code), script, and/or any other entity comprising a set of instructions to be performed. When a source program is utilized, the program may be translated via a compiler, assembler, interpreter, or the like, which may or may not be included within memory 125, 126. Furthermore, the gaming software can be written as (a) an object oriented programming language, which has classes of data and methods; or (b) a procedure programming language, which has routines, subroutines, and/or functions, for example but not limited to, C, C++, Pascal, Basic, Fortran, Cobol, Perl, Java, ASP, and Ada.

The gaming software can be stored on any computer readable medium for use by or in connection with any computer related system or method. In the context of this document, a computer readable medium is an electronic, magnetic, optical, or other physical device or means that can contain or store a computer program for use by or in connection with a computer related system or method. The gaming software can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

Figure 2:
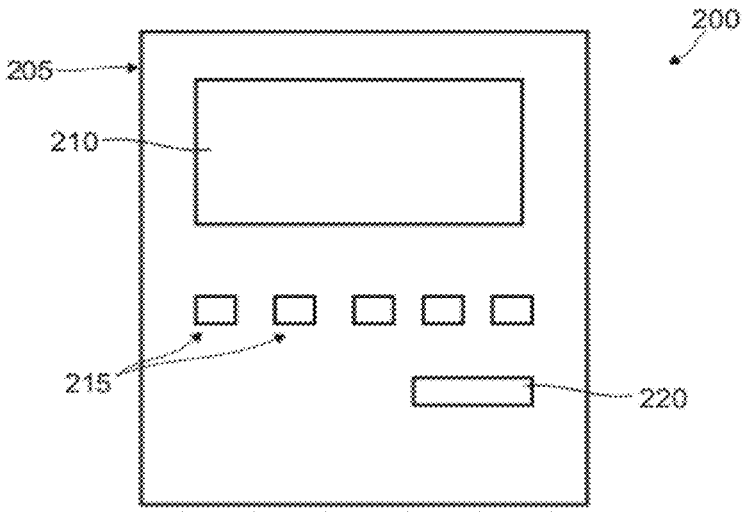
FIG. 2 illustrates an electronic gaming machine of the type which can facilitate the embodiments of the present invention.

FIG. 2 depicts an embodiment of an electronic gaming machine 200. The gaming machine 200 comprises a cabinet 205 housing a display 210 for displaying primary game outcomes. Typically, the display 210 is a flat panel LCD or plasma monitor for displaying a primary game video reels. However, any display means known in the art may be employed. Alternatively, the electronic gaming machine may be a slot machine including mechanical reels rather than video reels or a combination of mechanical reels and a transmissive LCD monitor.

Proximate to the display 210 are a series of electromechanical buttons 215 positioned on the cabinet 205 for use as a user interface for controlling game play such as selecting a bet amount, commencing play and cashing out (i.e., terminating game play and retrieving the monetary value corresponding to the remaining game credits). The specific arrangement and function of each of the electromechanical buttons 215 is dependent upon the specific rules of the game being played on the gaming machine 200. In one embodiment, the display 210 is a "touch screen" monitor upon which icons corresponding to some or all of the electromechanical buttons 215 appear. The user can activate the functions associated with the icons by simply touching the appropriate area of the display 210 rather than depressing the electromechanical buttons 215.

The gaming machine 200 also includes a wager input interface 220, such as a bill acceptor into which a player inserts paper currency and receives credit on the gaming machine 200 for the amount deposited. In alternate embodiments, the wager input interface 220 can be a ticket reader, a magnetic card reader, or similar mechanisms, into which the player places a ticket or magnetic card encoded with a monetary value purchased from a cashier's station or kiosk.

The embodiments of the present invention involve a fixed bonus code formed of several symbols and a dynamic game code formed of several symbols. One or more players playing multiple designated electronic gaming machines 110 attempt to match the dynamic game code to the bonus code to win a fixed jackpot or progressive jackpot. At least one single dynamic game code symbol adjusts in a random direction within a predefined fixed range of symbols responsive to each play of a corresponding electronic gaming machine 110. Once a game code symbol matches a corresponding bonus code symbol, the game code symbol locks up such that the matching game code symbol cannot adjust again until the jackpot is won. Different electronic gaming machines may be switched or re-assigned to drive different game code symbols as needed and multiple gaming machines may drive a single game code symbol.

Figure 3:
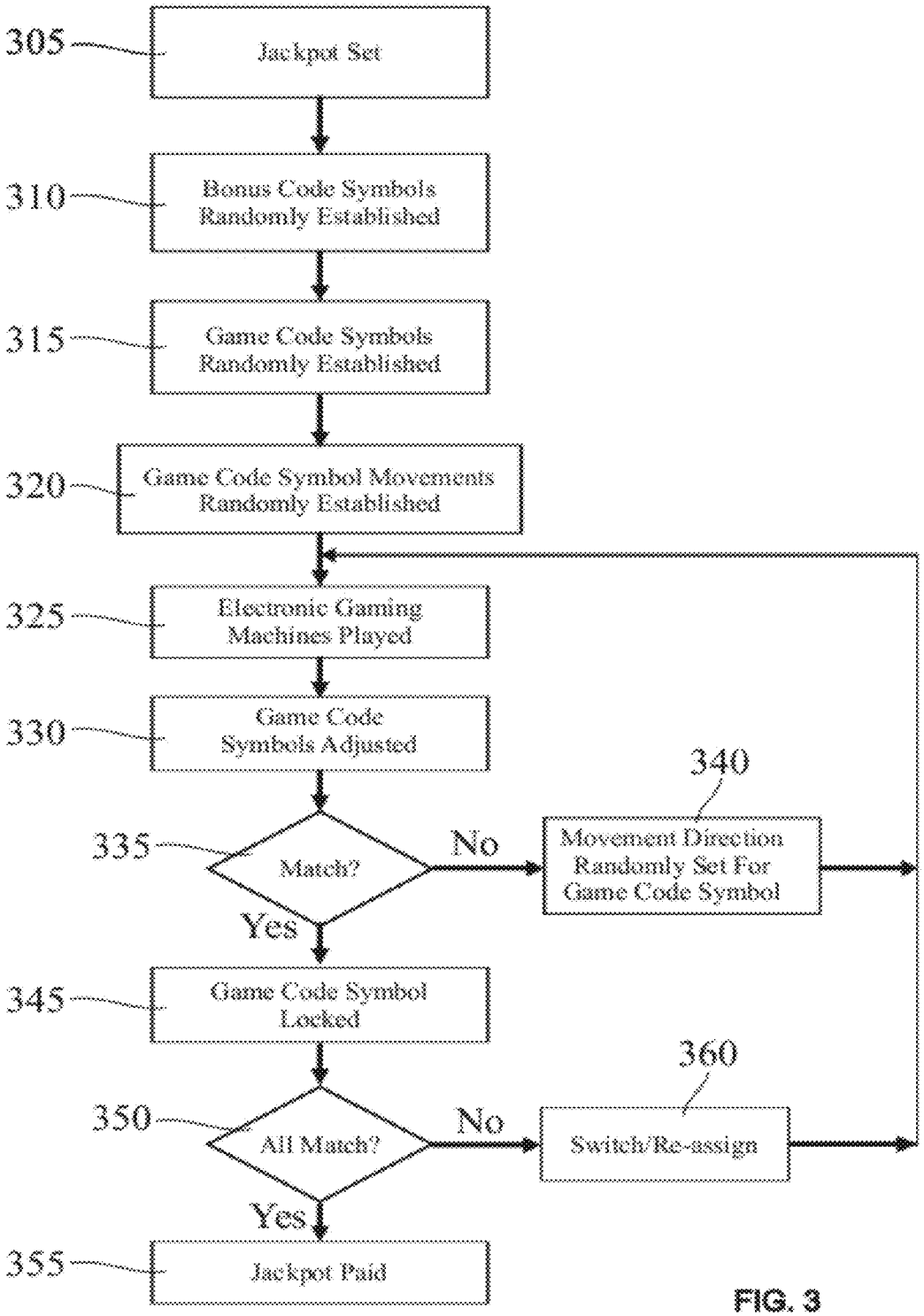
FIG. 3 illustrates a flow chart detailing broadly a methodology according to the embodiments of the present invention.

Flow chart 300 shown in FIG. 3 details a methodology of conducting games of chance on networked electronic gaming machines according to the embodiments of the present invention. At 305, a jackpot amount is established. In one embodiment, the jackpot is progressive such that a percentage of placed bets is used to fund the jackpot. Alternatively, the jackpot is fixed. At 310, a bonus code of several bonus code symbols is randomly selected and displayed on the bank display 120 and/or electronic gaming machine displays. The bonus code symbols may be based on a set or list of a combination of numbers and letters. In one embodiment, each bonus code symbol is selected from numbers 0-9 and letters A-Z. In one embodiment, the quantity of bonus code symbols matches the quantity of networked electronic gaming machines 110 on which players can win the jackpot. So, a bank of five electronic gaming machines utilizes a five symbol bonus code. At 315, a game code of several game code symbols is randomly selected from the same pool of symbols (i.e. being based on the same set of symbols from which the bonus code is based) and displayed on the bank display 120 and/or electronic gaming machine displays. Ideally, the bonus code symbol and the dynamic game code are displayed adjacent to one another (see FIGS. 6*a* through 6*d*) with a first bonus code symbol adjacent to a first game code symbol, a second bonus code symbol adjacent to a second game code symbol and so on allowing players to easily and quickly determine the correspondence between the respective symbols. The display should also depict which electronic gaming machine is driving which game code symbol. At 320, a random directional movement signal for each game code symbol is also set. The directional movement in this context refers to the direction within the set or list or pool of symbols the next symbol will be selected. If the pool for example is composed of the sequential characters of the Latin alphabet and a current dynamic game code symbol is "D" then the directional movement signal may be either to the next higher character "E" or next lower character "C."

At 325, electronic gaming machines 110 are played. At 330, responsive to game play on the electronic gaming machines 110, corresponding game code symbols are adjusted in the prescribed direction set at 320. For example, if the game code symbol is number "7," it adjusts to "6" or "8" depending on the prescribed direction of movement. Likewise, if the game code symbol is the letter "G," it adjusts to "F" or "H" depending on the prescribed direction of movement. Each game code symbol is initially controlled by play on a corresponding electronic gaming machine which as set forth above and below can be switched. At 335, the new game code symbol is compared to the corresponding bonus game symbol. If there is no match, at 340, a new random direction of movement for the game code symbol is set. If there is a match, at 345, the game code symbol is locked. Then, at 350, it is determined if all game code symbols have been locked. If so, at 355, the jackpot is distributed to players playing the networked electronic gaming machines. It is also possible to provide awards to one or more players responsive to individual game code symbols matching corresponding bonus code symbols. That is, as each game code symbol is locked, one or more players may be provided an award less than the jackpot. If not, at 360, the electronic gaming machine which was driving the locked game code symbol is switched or re-assigned to drive a different unlocked game code symbol. The flow chart 300 then loops back to 320.

Although not detailed in flow chart 300, play of multiple electronic gaming machines may drive a single game code symbol. For example, assuming four of five possible game code symbols are locked and multiple players are playing networked electronic gaming machines, each electronic gaming machine may be switched or re-assigned to drive the remaining game code symbol. In such an embodiment, the game code symbol may adjust more frequently based on play at multiple electronic gaming machines. The game controller 105 queues the various game plays to allow the adjustment of the game code symbol to be visualized by the players.

Figure 4A:
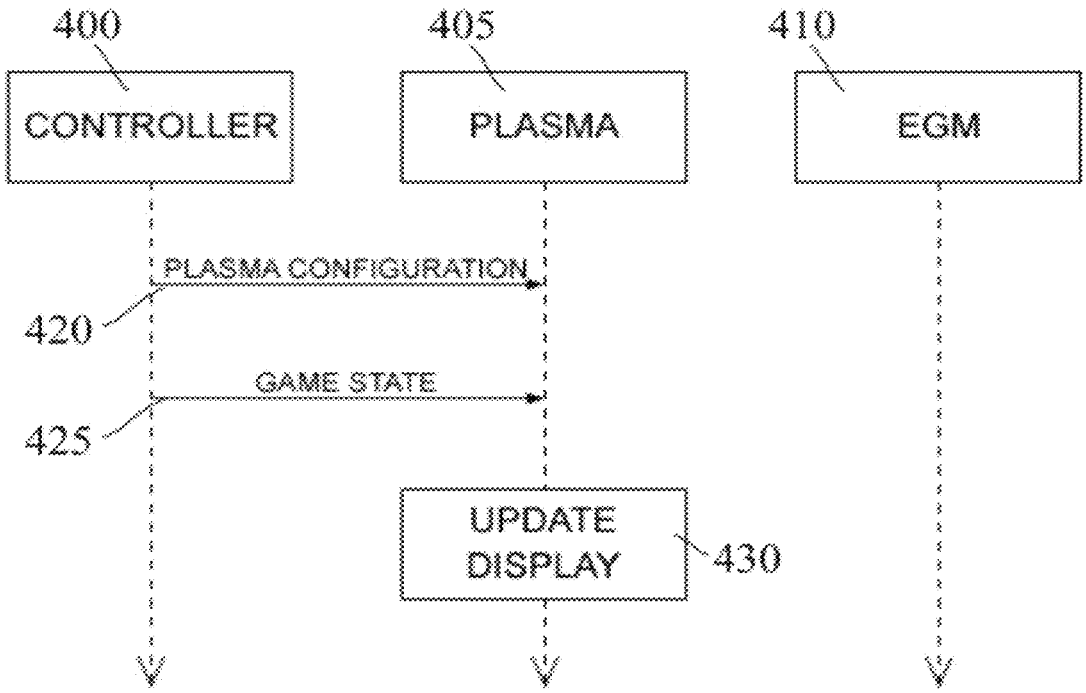
FIGS. 4*a*-4*c* illustrate various flow charts detailing certain communication methodologies between a game controller, display and electronic gaming machine according to the embodiments of the present invention.
Figure 4B:
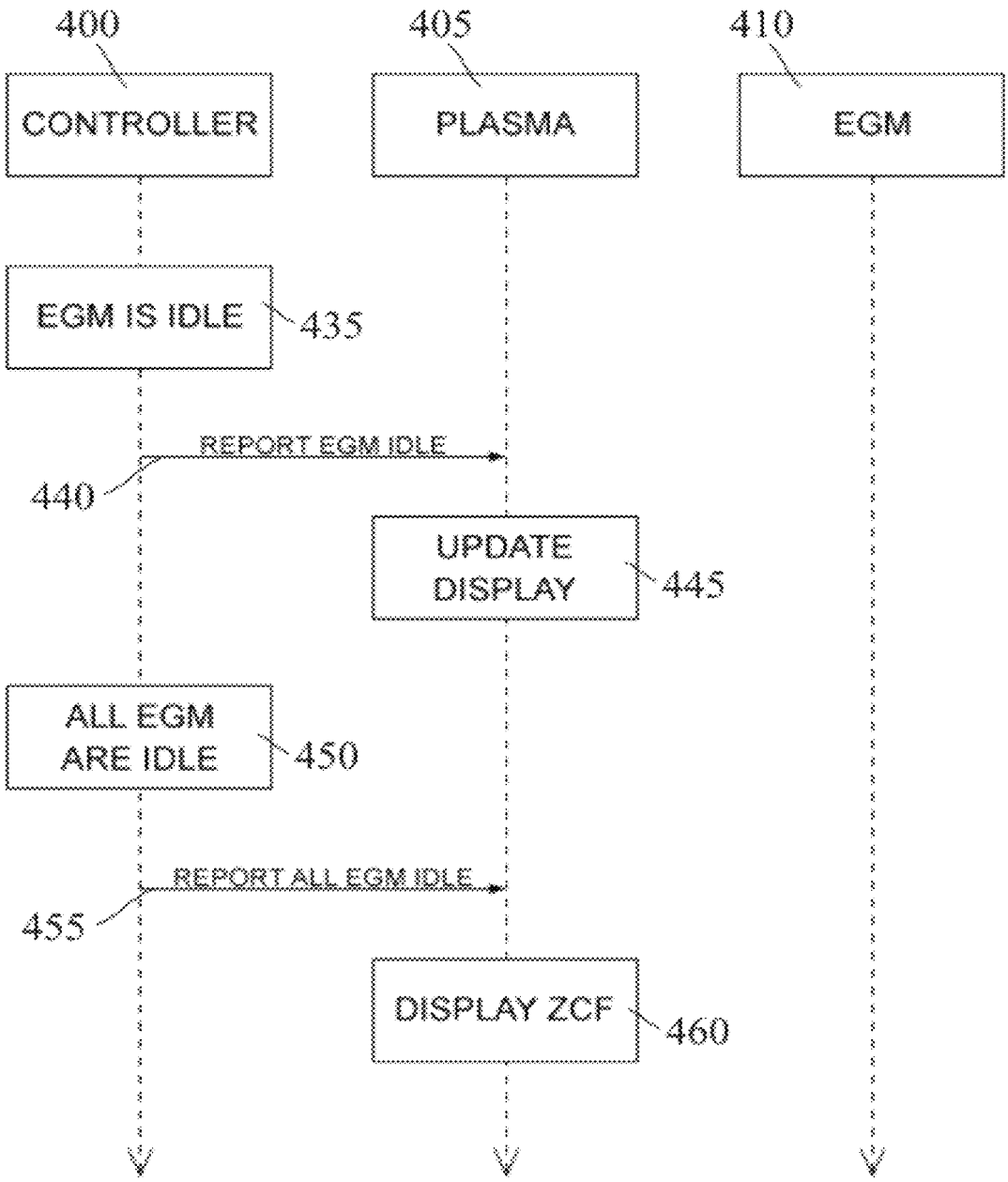
Figure 4C:
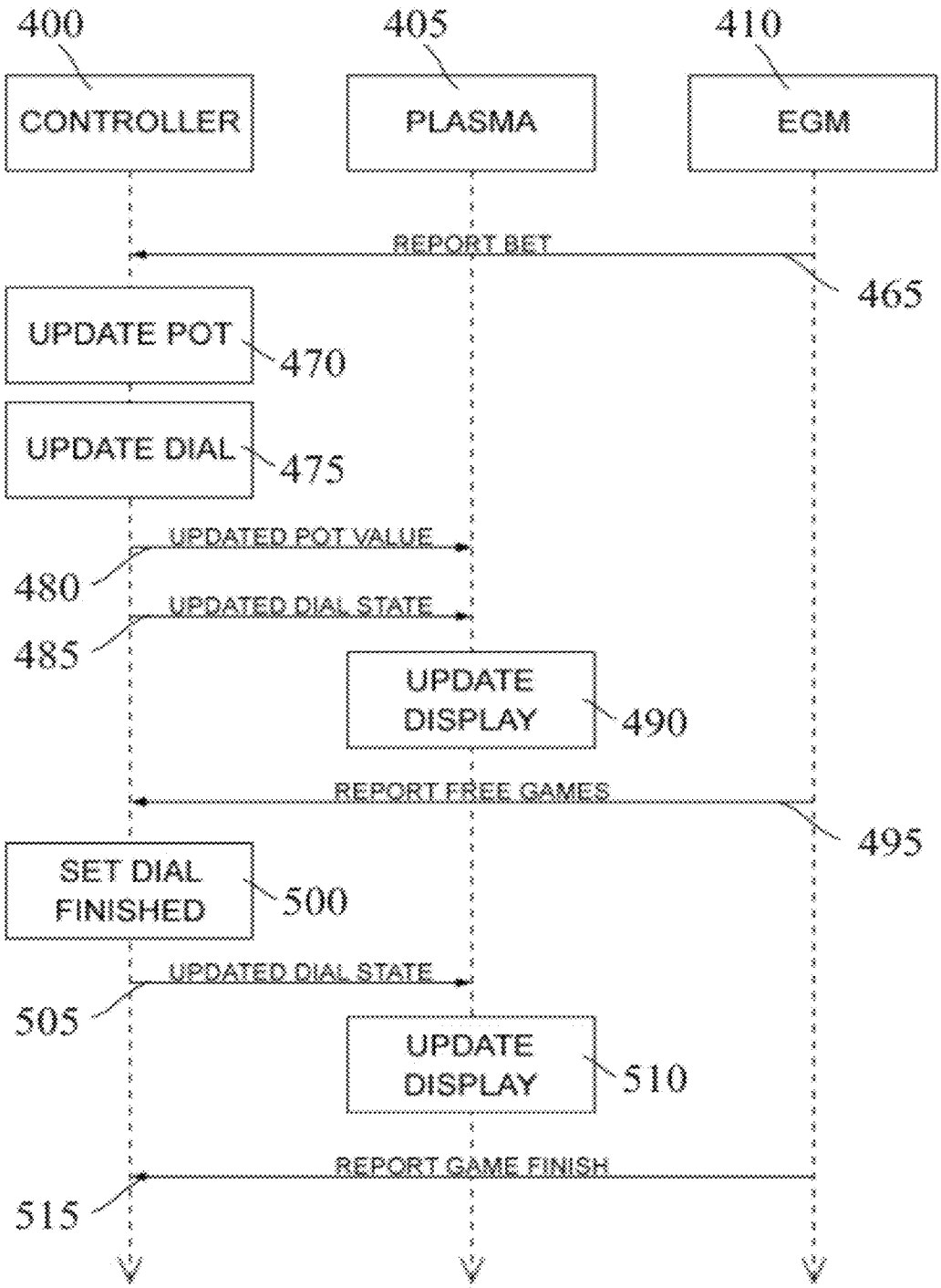

FIGS. 4*a*-4*c* show various flowcharts detailing interaction between a controller 400, display 405 and electronic gaming machine 410. FIG. 4*a* shows that the controller 400 configures 420 the display 405 and communicates game state 425 to the display 405. Responsive thereto, the display 405 is updated 430. As shown in FIG. 4*b*, responsive to the electronic gaming machine being idle 435, the controller 400 reports to the display 405 that the electronic gaming machine is idle 440. Responsive thereto, the display 405 is updated 445. Responsive to all electronic gaming machines being idle 450, the controller 400 reports to the display 405 that all electronic gaming machines are idle 455. Responsive thereto, the display 405 shows attract mode content (ZCF) 460.

FIG. 4*c* shows a methodology for updating a progressive jackpot value and the inclusion of free game plays. Electronic gaming machine 410 reports a bet or play 465 to controller 400. The controller 400 updates the amount of the progressive jackpot 470. The game code symbol corresponding to the play of electronic gaming machine 410 is then adjusted 475 or updated. Both the updated progressive jackpot amount 480 and game code symbols 485 are reported to the display 405. Responsive thereto, the display 405 is updated 490. Responsive to a pre-established game outcome, the electronic gaming machine 410 awards the player free plays and reports 495 the same to the controller 405. Responsive to one such free play, the game code symbol matches the corresponding bonus code symbol which causes the game code symbol to be locked 500. Responsive thereto, the controller 400 reports a new bonus code symbol(s) and game code symbol(s) 505. Responsive thereto, the display 405 is updated 510. The electronic gaming machine 410 finally reports a game finish 515.

Figure 5A:
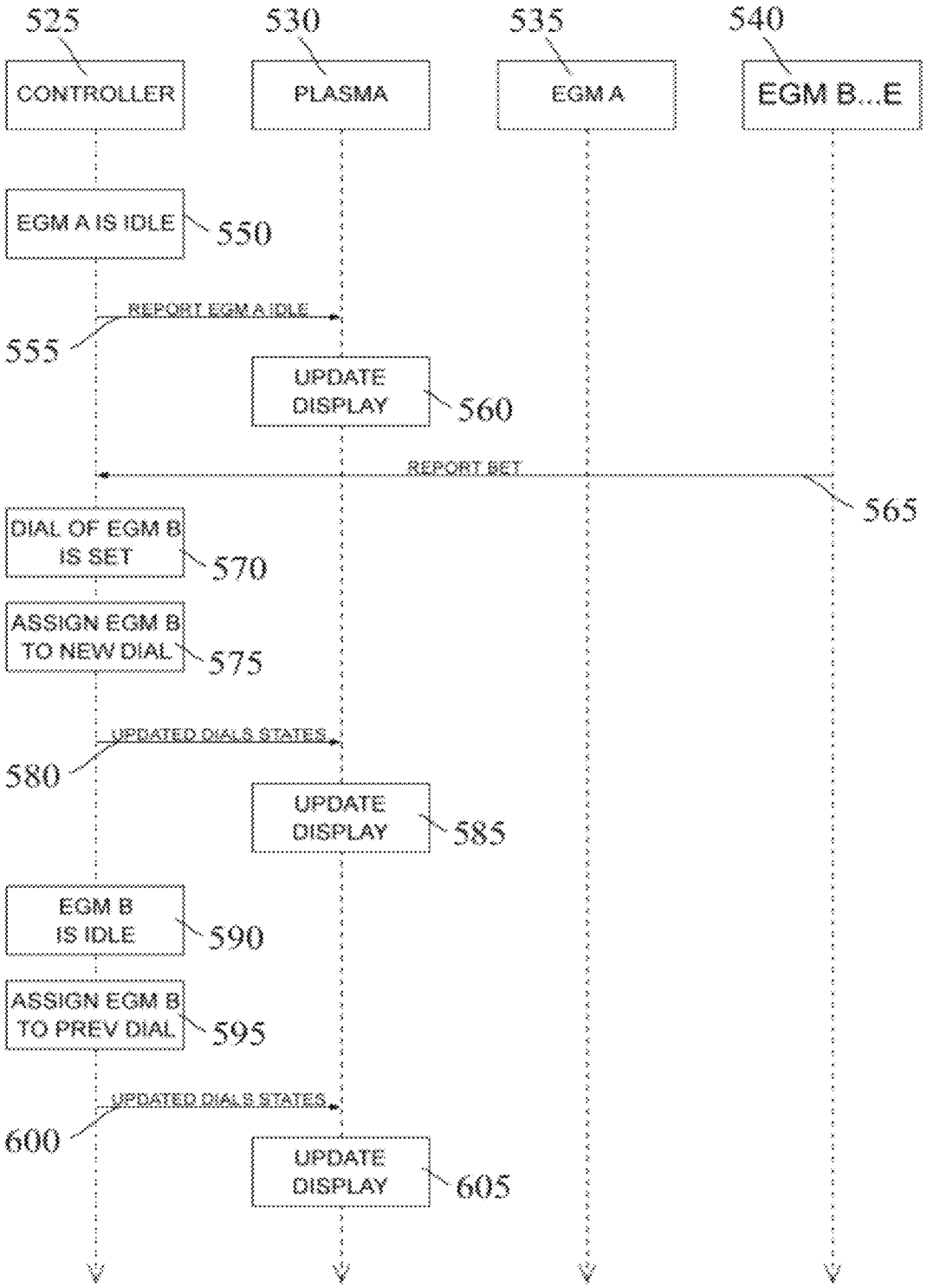
FIGS. 5*a*-5*b* illustrate various flow charts detailing certain communication methodologies between a game controller, bank display and multiple electronic gaming machines according to the embodiments of the present invention.

FIG. 5*a* shows a methodology for re-assigning an electronic gaming machine when a game code symbol is locked. As shown in FIG. 5*a*, responsive to electronic gaming machine A being idle 550, controller 525 reports to bank display 530 that electronic gaming machine A 535 is idle 555. Responsive thereto, the bank display 530 is updated 560. Plays 565 of electronic gaming machine B 540, for example, are reported to the controller 525. If the game code being driven by electronic gaming machine B 540 matches the corresponding bonus code symbol, the bonus code is set or locked 570. Then, electronic gaming machine B 540 is re-assigned or switched such that plays thereof drive a different game code symbol 575. The new correspondence between electronic gaming machine B 540 and game code symbols is reported 580 to the bank display 530. Responsive thereto, the bank display 530 is updated 585 such that the bank display 530 shows which electronic gaming machine is driving which game code symbol. If electronic gaming machine B 540 becomes idle 590, the controller switches or re-assigns electronic gaming machine B 540 to driving the previous locked game code symbol 595. In this manner, other electronic gaming machines can be switched or re-assigned to the game code symbol if necessary. If electronic gaming machine B 540 is played subsequent to being idle, the controller 525 will once again switch it such that play drives an unlocked game code symbol. The new assignment of electronic gaming machine B 540 is reported 600 to the bank display 530 which again shows 605 the correspondence between the electronic gaming machines and the game code symbols.

Figure 5B:
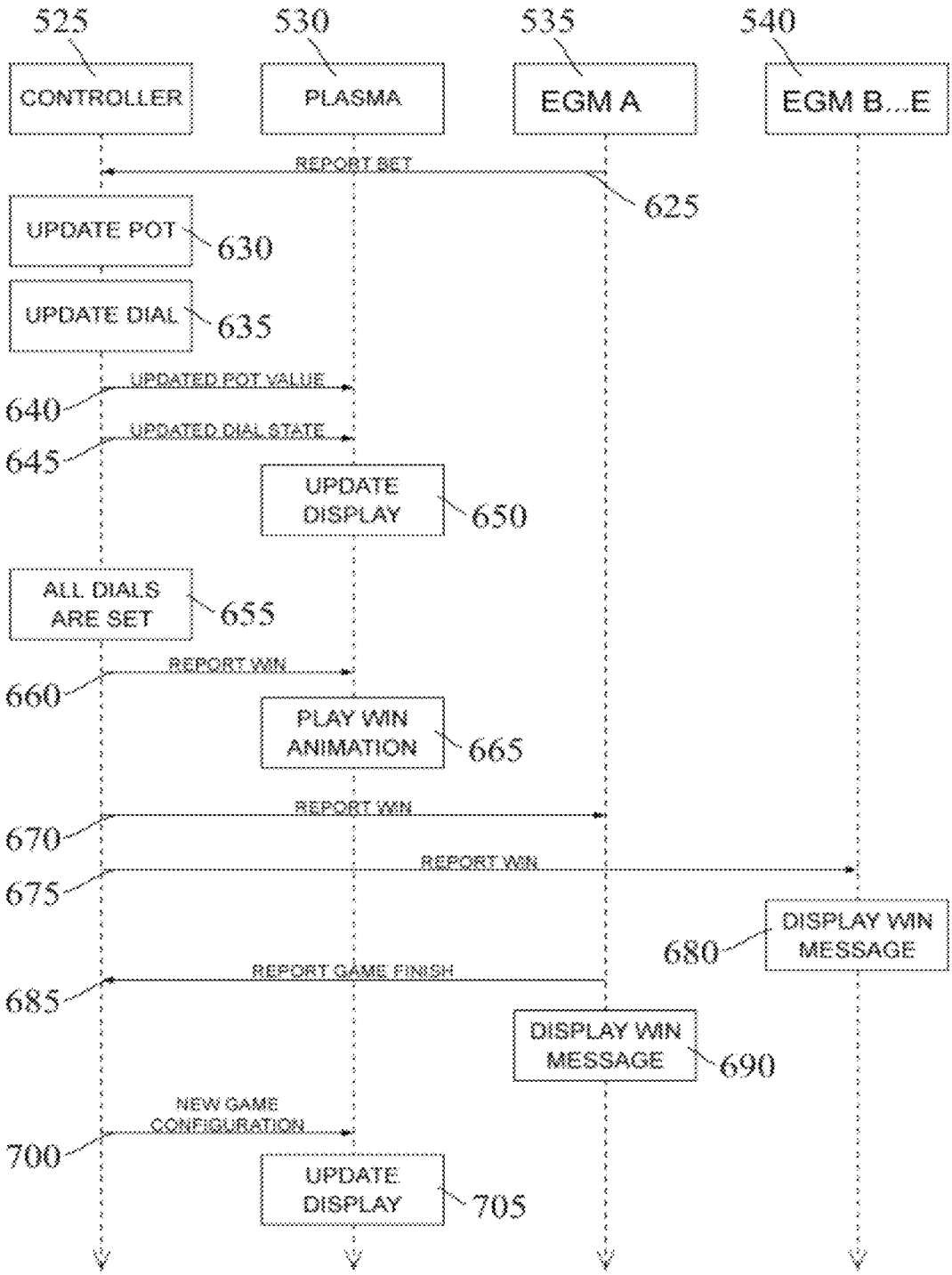

FIG. 5*b* shows a methodology for updating a progressive jackpot value and providing a jackpot payout. Electronic gaming machine A 535 reports a bet or play 625 to controller 500. The controller 500 updates the amount of the progressive jackpot 630. The game code symbol corresponding to the play of electronic gaming machine A 535 is then adjusted 635. Both the updated progressive jackpot amount 640 and game code symbols 645 are reported to the bank display 530. Responsive thereto, the bank display 530 is updated 650. Responsive to all game code symbols being locked 655 because they match respective bonus code symbols (i.e., progressive jackpot won), the controller 525 reports the progressive jackpot win 660 to the bank display 530. Responsive thereto, the bank display 530 shows a pre-programmed win animation 665. The progressive jackpot win is also reported 670 to the electronic game machine A 535 which triggered the progressive jackpot win and reported 675 to all other networked electronic gaming machines 540. Each of the electronic gaming machines 540 which did not trigger the progressive jackpot win then displays a win message 680. Subsequent to a game finish report 685 from electronic gaming machine A 535 to the controller 525, electronic gaming machine A 535 displays a win message 690. The controller 525 then causes new randomly fixed bonus code symbols and initial dynamic game code symbols to be established 700 and reported to the bank display 530. Responsive thereto, the bank display 530 is updated 705.

Figure 6A:
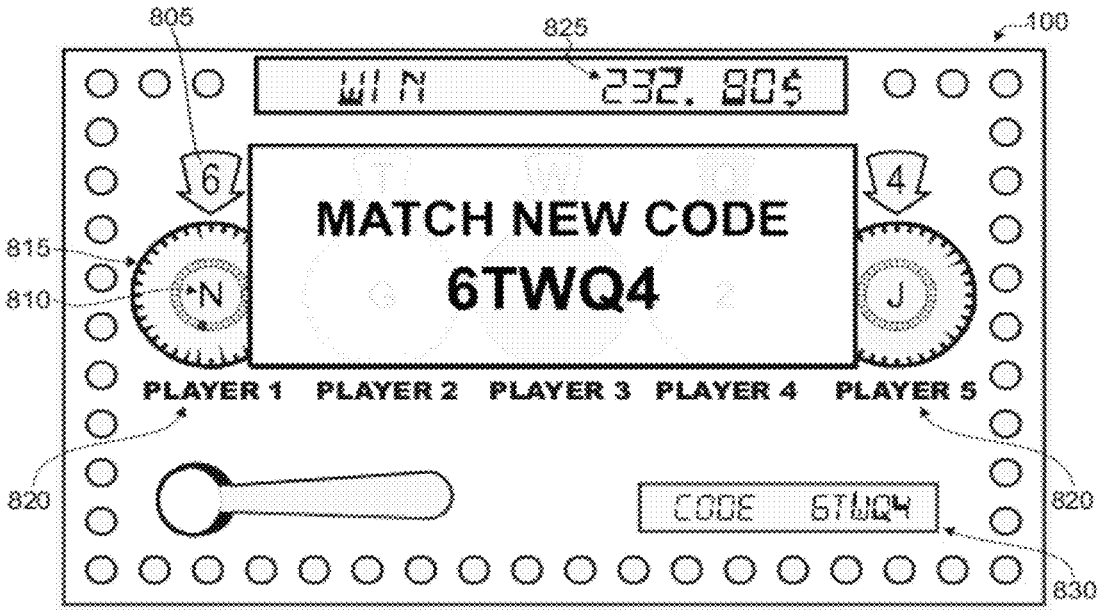
FIGS. 6*a*-6*d* illustrate exemplary depictions of a safe cracking theme associated with the embodiments of the present invention.
Figure 6B:
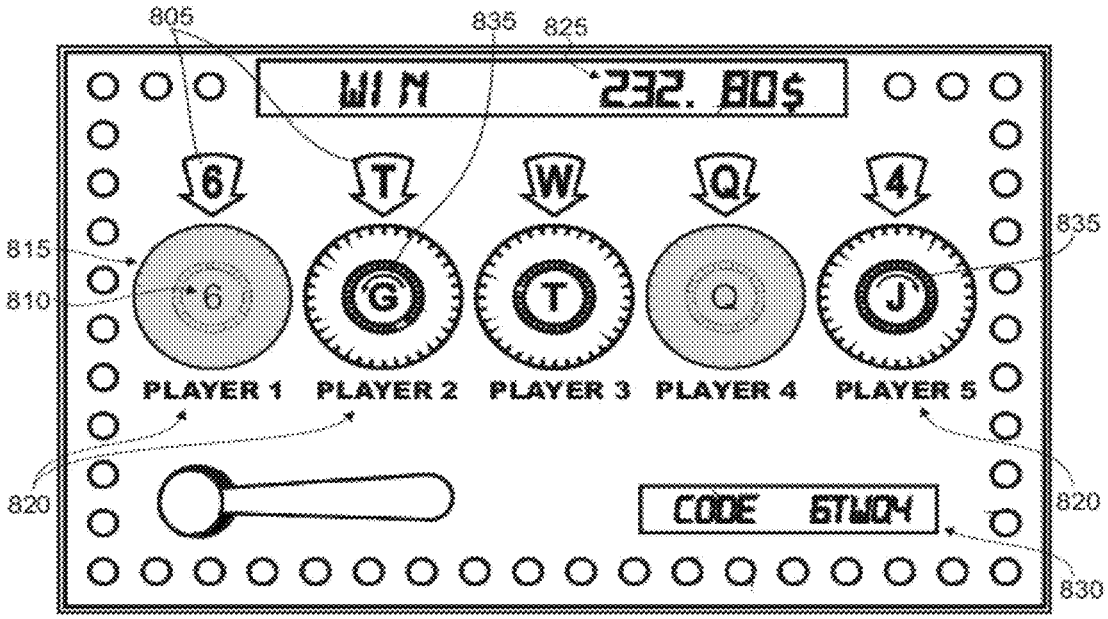
Figure 6C:
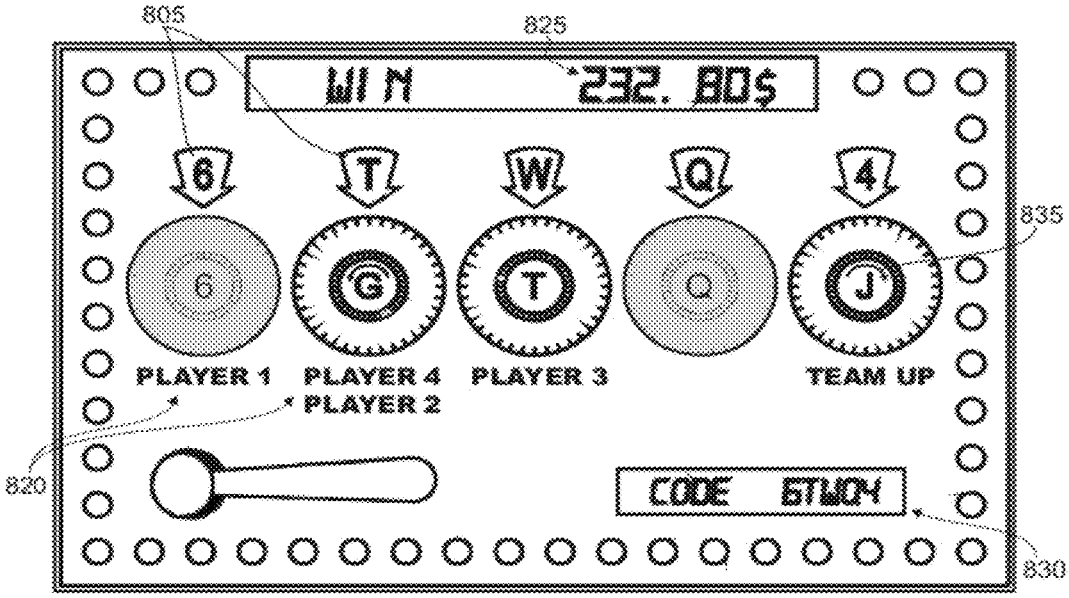
Figure 6D:
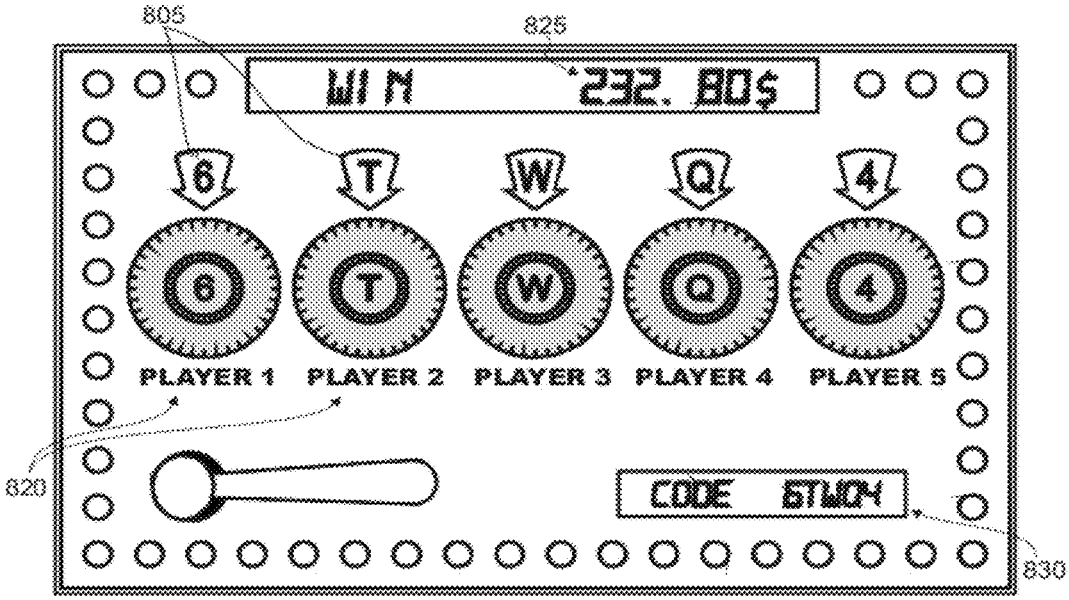

FIGS. 6*a*-6*d* depict various screen shots of a gaming machine display or bank display used to facilitate the embodiments of the present invention. FIGS. 6*a*-6*d* show exemplary bonus code symbols and game code symbols presented to players as a safe-cracking theme. FIG. 6*a* shows a safe door theme 800 depicting bonus code symbols 805 above game code symbols 810 wherein the game code symbols are presented on safe dials 815. Beneath each game code symbol 810 is a player number 820 representative of an electronic gaming machine 110 designated to drive the respective game code symbol 810. A progressive jackpot amount 825 is depicted above the bonus code symbols 805. In this example a new game sequence is initiated by indicating on the display in an overlay manner a code message "MATCH NEW CODE" together with the new bonus code to be matched. The bonus code is also displayed on a distinct display 830 and the previously presented overly code message disappears. FIG. 6*b* shows directional arrows 835 depicting which direction each of the game code symbols 810 will move or adjust responsive to play of a next game of a corresponding electronic gaming machine 110. The direction of the directional arrows 835 is randomly determined after each play of a corresponding electronic gaming machine. FIG. 6*c* shows a situation when players □ here Player 4□ has already matched "his" 4th dial with the proper bonus code symbol, and some other terminal □ here Terminal 2□ is not active meaning no player is playing and influencing dial 2 in which case Player 4 may be switched or re-assigned to free dial 2, which means, that his plays of his electronic gaming machine now influence dial 2. But, if meanwhile, Player 2 starts playing terminal 2, he is added as the second player such that plays of Player 4 and Player 2 both influence dial 2. FIG. 6*c* also shows a "TEAM UP" message below the outermost right hand dial 5 □ which means, that if some of the active players lock their dials, they can still bet further and will be switched to the free dial to continue matching the entire code. FIG. 6*d* shows each of the game code symbols 810 matching respective bonus code symbols 805 resulting in a shared win of the progressive jackpot by players playing networked electronic gaming machines. In practice, when a game code symbol 810 matches a respective bonus code symbol 805, the game code symbol 810 locks and the corresponding dial changes colors or is otherwise highlighted relative to unlocked game code symbols 810.

In one embodiment, an attract mode for attracting players to start game play may be implemented on the gaming system. During the attract mode a sequence of messages may be shown in emphasized manner on the display, for example a first message "Team Up To Win!" is shown; a second message "With"; and a third message "Bank Blaster" may be shown. Bank Blaster is a potential fanciful brand name for a safe cracking themed game played according to the embodiments of the present invention. Additional successive messages may be displayed during the attract mode including a message "Bet To Move The Dial"; a message "Try To Match The Code"; and a message "Good Luck." Further successive information may be displayed responsive to the jackpot being won including an image depicting the safe door opening to reveal gold bars; an image depicting "Win"; and an image depicting a distribution of the progressive jackpot by player number. Those skilled in the art will recognize that the embodiments of the present invention may be utilized with any desirable theme.

Figure 7:
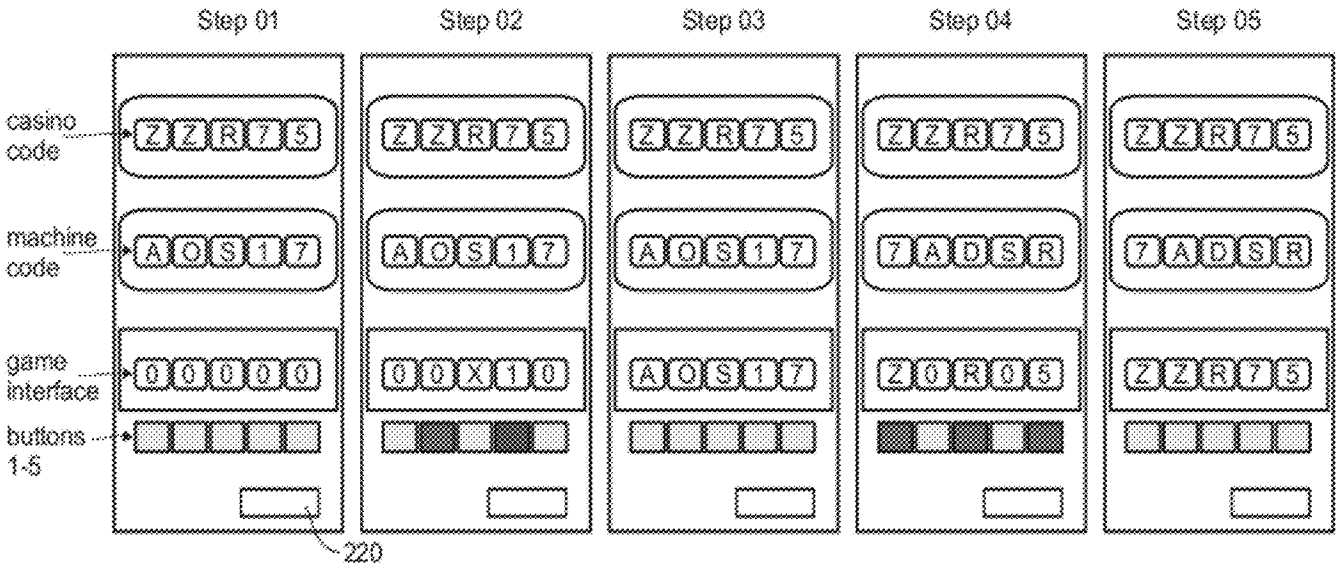
FIG. 7 illustrates another embodiment of the present invention utilizing a stand alone electronic gaming machine allowing players to hold game code symbols in an effort to match a machine and/or casino code.

FIG. 7 shows a gaming machine according to another embodiment of the invention. A sequence of five steps, step 01-05, is shown related to machine operation in different gaming states. The gaming machine comprises a user interface comprising buttons 1-5 (in order from left to right). The gaming machine further comprises a game interface comprising game symbol positions 1-5 corresponding to a respective one of the buttons 1-5. At step 01, a casino code and a machine game code are generated/selected. At step 02, the game is started at the gaming machine and machine button 2 and button 4 are indicated to hold respective code positions (similar to draw poker game where cards may be held). At step 03, a win situation is shown where the player has matched respective game code symbols to machine code symbols. Payouts may be provided based on matching one or more game codes with the machine codes. At step 04, a new machine code has been generated/selected and a player has started a new game and has used buttons 1, 3 and 5 to hold corresponding game code symbols such that the game code symbols corresponding to the buttons will not be changed in the next game play (i.e., only position 2 and position 4 will receive a new game symbol randomly assigned). At step 05, a win situation is shown where the player has matched respective game code symbols to casino code symbols. Payouts may be provided based on matching one or more game codes with the machine codes. A selector (not shown in FIG. 7) may be present to allow player selection between attempting to match game codes with the machine code or the casino code. In case a casino code is provided, several gaming machines may be networked together via a common game controller and the casino code may be provided to the large bank monitor or display 120.

Figure 8:
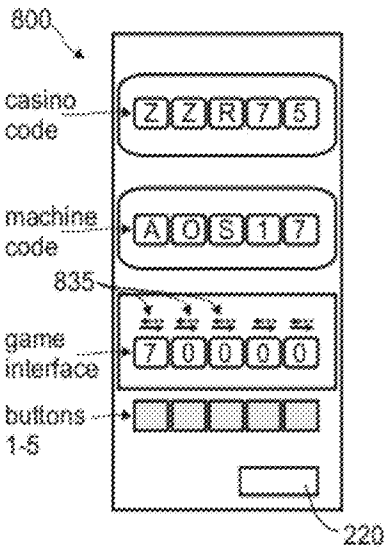
FIG. 8 illustrates another embodiment of the present invention involving a stand alone gaming machine.

FIG. 8 shows a gaming machine 800 according to another embodiment of the present invention. Responsive to game play initiated by means of the respective buttons 1-5 on the electronic gaming machine 800, corresponding game code symbols at the game interface positions 1-5 are adjusted in the prescribed direction—similar to that described in the context of FIG. 2. For example, if the game code symbol on position 1 is symbol number "7," it adjusts to a symbol "6" or symbol "8" depending on the prescribed direction of movement. Likewise, if the game code symbol is letter the "G," it adjusts to "F" or "H" depending on the prescribed direction of movement. The direction of movement is indicated by directional arrows 835. The respective directional arrows 835 may be randomly set after each game play initiated by a respective button 1-5. The directional movement in this context refers to the direction within the set or list or pool of symbols the next symbol will be selected. The list of symbols may be displayed on a separate display such that the user may easily realize the sequenced order of the symbols in the list.

Although the invention has been described in detail with reference to several embodiments, additional variations and modifications exist within the scope and spirit of the invention.

We claim:

1. A gaming system comprising:

multiple electronic gaming machines, each configured to play a game and including at least:

a display;

an interface capable of accepting instructions from a player to initiate play of the game;

memory capable of storing a plurality of software instructions;

a random number generator capable of randomly generating game outcomes; and a processor for controlling the display, the interface and the random number generator, a controller in communication with each of said multiple electronic gaming machines, said controller configured to:

randomly select fixed bonus code symbols from a pool of symbols;

randomly select a quantity of game code symbols from said pool of symbols wherein said quantity of game code symbols equals a quantity of fixed bonus game symbols;

prior to each play of each of said multiple electronic gaming machines, randomly determine a direction of movement for selection of each of said game code symbols;

responsive to play of one of said multiple electronic gaming machines, adjust at least one game code symbol in said randomly determined direction of movement;

compare respective adjusted game code symbols to corresponding bonus code symbols;

lock game code symbols matching said bonus code symbols; and responsive to each of said game code symbols matching a corresponding one of said bonus code symbols, trigger an award to players playing one of said networked multiple electronic gaming machines.

2. The gaming system of claim 1 wherein the controller is further configured to select bonus code symbols and game code symbols from a pool of numbers from 0 through 9 and letters from A through Z.

3. The gaming system of claim 1 wherein the controller is further configured to randomly generate a number of fixed bonus code symbols equal to a number of networked electronic gaming machines.

4. A gaming system comprising:

multiple electronic gaming machines, each configured to play a game and including at least:

a display;

an interface capable of accepting instructions from a player to initiate play of the game;

memory capable of storing a plurality of software instructions;

a random number generator capable of randomly generating game outcomes; and a processor for controlling the display, the interface and the random number generator, a controller in communication with each of said multiple electronic gaming machines, said controller configured to:

randomly select fixed bonus code symbols from a pool of symbols;

randomly select a quantity of game code symbols from said pool of symbols wherein said quantity of game code symbols equal a quantity of fixed bonus game symbols;

assign each of said electronic gaming machines to a different bonus game symbol;

for each play of each of said multiple electronic gaming machines, randomly determine a direction of movement for each of said respective game code symbols;

responsive to play of one of said multiple electronic gaming machines, adjust an assigned game code symbol in said randomly determined direction of movement;

compare respective adjusted game code symbols to corresponding bonus code symbols;

lock game code symbols matching said bonus code symbols;

for each locked game code symbol, responsive to play assign an electronic gaming machine to a unlocked game code symbol; and responsive to each of said game code symbols matching a corresponding one of said bonus code symbols, triggering an award to players playing one of said networked multiple electronic gaming machines.

5. The gaming system of claim 4 wherein the controller is further configured to select bonus code symbols and game code symbols from a pool of numbers from 0 through 9 and letters from A through Z.

6. The gaming system of claim 4 wherein the controller is further configured to randomly generate a number of fixed bonus code symbols equal to a number of networked electronic gaming machines.

7. A method of conducting a game of chance using multiple electronic gaming machines, each configured to play a game and including at least: a display; an interface capable of accepting instructions from a player to initiate play of the game; memory capable of storing a plurality of software instructions; a random number generator capable of randomly generating game outcomes; and a processor for controlling the display, the interface and the random number generator; and a controller in communication with each of said multiple electronic gaming machines, comprising:

randomly selecting fixed bonus code symbols from a pool of symbols;

randomly selecting a quantity of game code symbols from said pool of symbols wherein said quantity of game code symbols equal a quantity of fixed bonus game symbols;

prior to each play of each of said multiple electronic gaming machines, randomly determining a direction of movement for each of said game code symbols;

responsive to play of one of said multiple electronic gaming machines, adjusting at least one game code symbol in said randomly determined direction of movement;

comparing respective moved game code symbols to corresponding bonus code symbols;

locking game code symbols matching said bonus code symbols; and responsive to each of said game code symbols matching a corresponding one of said bonus code symbols, triggering an award to players playing one of said networked multiple electronic gaming machines.

8. The method of claim 7 further comprising selecting bonus code symbols and game code symbols from a pool of numbers from 0 through 9 and letters from A through Z.

9. The method of claim 7 further comprising randomly generating a number of fixed bonus code symbols equal to a number of electronic gaming machines.

10. A method of conducting a game of chance using multiple electronic gaming machines, each configured to play a game and including at least: a display; an interface capable of accepting instructions from a player to initiate play of the game; memory capable of storing a plurality of software instructions; a random number generator capable of randomly generating game outcomes; and a processor for controlling the display, the interface and the random number generator; and a controller in communication with each of said multiple electronic gaming machines, comprising:

randomly selecting fixed bonus code symbols from a pool of symbols;

randomly selecting a quantity of game code symbols from said pool of symbols wherein said quantity of game code symbols equal a quantity of fixed bonus game symbols;

assigning each of said electronic gaming machines to a different bonus game symbol;

for each play of each of said multiple electronic gaming machines, randomly determining a direction of movement for each of said respective game code symbols;

responsive to play of one of said multiple electronic gaming machines, adjusting an assigned game code symbol in said randomly determined direction of movement;

comparing respective moved game code symbols to corresponding bonus code symbols;

lock game code symbols matching said bonus code symbols;

for each locked game code symbol, and responsive to play assigning an electronic gaming machine to an unlocked game code symbol; and responsive to each of said game code symbols matching a corresponding one of said bonus code symbols, triggering an award to players playing one of said networked multiple electronic gaming machines.

11. The method of claim 10 further comprising selecting bonus code symbols and game code symbols from a pool of numbers from 0 through 9 and letters from A through Z.

12. The method of claim 10 further comprising randomly generating a number of fixed bonus code symbols equal to a number of electronic gaming machines.

* * * * *